US009045920B2

(12) United States Patent
Minemura

(10) Patent No.: US 9,045,920 B2
(45) Date of Patent: Jun. 2, 2015

(54) VEHICLE DOOR INSIDE HANDLE DEVICE

(75) Inventor: Ryuji Minemura, Kanagawa (JP)

(73) Assignee: ALPHA CORPORATION, Yokohama-shi, Kanagawa (JP)

( * ) Notice: Subject to any disclaimer, the term of this patent is extended or adjusted under 35 U.S.C. 154(b) by 0 days.

(21) Appl. No.: 13/821,806

(22) PCT Filed: Oct. 14, 2011

(86) PCT No.: PCT/JP2011/073730

§ 371 (c)(1),
(2), (4) Date: Mar. 8, 2013

(87) PCT Pub. No.: WO2012/050213

PCT Pub. Date: Apr. 19, 2012

(65) Prior Publication Data

US 2013/0168980 A1 Jul. 4, 2013

(30) Foreign Application Priority Data

Oct. 15, 2010 (JP) ..... 2010-232704

(51) Int. Cl.
*E05B 3/00* (2006.01)
*E05B 85/12* (2014.01)
*E05B 79/06* (2014.01)

(52) U.S. Cl.
CPC ..... *E05B 85/12* (2013.01); *E05B 79/06* (2013.01); *E05B 85/13* (2013.01); *Y10S 292/53* (2013.01); *Y10S 292/64* (2013.01)

(58) Field of Classification Search
CPC ..... E05B 79/06; E05B 85/12; E05B 85/13
USPC ..... 292/336.3, 80, 81, 87, DIG. 53, DIG. 54, 292/DIG. 64
See application file for complete search history.

(56) References Cited

U.S. PATENT DOCUMENTS 7,104,575 B2 * 9/2006 Kakita ..... 292/348
2009/0144940 A1 6/2009 Yamada et al.

FOREIGN PATENT DOCUMENTS

| | | | |
|---|---|---|---|
| CN | A-101450637 | | 6/2009 |
| JP | 6-193330 | | 7/1994 |
| JP | 2003193708 A | * | 7/2003 |
| JP | 2005163291 A | * | 6/2005 |
| JP | B2-4198898 | | 10/2008 |
| JP | 2009-299264 | | 12/2009 |

* cited by examiner

*Primary Examiner* — Kristina Fulton
*Assistant Examiner* — Christine M Mills
(74) *Attorney, Agent, or Firm* — Drinker Biddle & Reath LLP

(57) ABSTRACT

A vehicle door handle device is provided with a handle base, an escutcheon member, and a plurality of connection portions which connect the handle base and the escutcheon member to each other. The plurality of connecting portions include: a first connecting portion including an inclined surface which causes a motion component force toward a frame exterior to be generated in the escutcheon member by a horizontal operating force applied to the escutcheon member, thereby unlocking the first connecting portion; a second connection portion which is unlocked by deforming the escutcheon member using a moveable region in a vicinity of the first connection portion generated by the unlocking in the first connecting portion; and an n-th connection portion which is unlocked by deforming the escutcheon member using the moveable region due to the unlocking in the preceding connection portions.

7 Claims, 6 Drawing Sheets

VEHICLE DOOR INSIDE HANDLE DEVICE

TECHNICAL FIELD

The present invention relates to a door inside handle device for a vehicle.

BACKGROUND ART

Patent Document 1 discloses an inside handle device in which a frame-shaped escutcheon member is connected to an upper end of a handle base. In the structure of Patent Document 1, the inside handle device includes an inside handle (operating handle) connected to the handle base and an inside handle bezel (escutcheon member).

Connecting operation of the escutcheon member to the handle base is carried out by locking a claw portion formed on the escutcheon member to a jaw portion of the handle base. Detaching operation of the escutcheon member is carried out by inserting a driver into a cut-out portion formed on the escutcheon member and then pulling the driver upward.

PRIOR ART DOCUMENT

Patent Document

Patent Document 1: JP-A-06-193330

However, in the structure disclosed in Patent Document 1, since a tool such as the driver is required, there is a drawback that the workability of the detaching operation of the escutcheon member becomes poor. Further, since the cut-out portion is exposed on the surface, there is a drawback that the aesthetic appearance is impaired.

SUMMARY OF INVENTION

Embodiments of the present invention provide a vehicle door inside handle device which is capable of improving a workability of a detaching operation of an escutcheon member and also improving an aesthetic appearance.

According to an embodiment of the present invention, a vehicle door handle device may include: a handle base 2 to which an operating handle 1 is pivotally supported; a frame-shaped escutcheon member 3 which is connected to an upper edge portion of the handle base 2 and is elastically deformably formed; and a plurality of connection portions 4 which connect the handle base 2 and the escutcheon member 3 to each other. Each of the plurality of connecting portions 4 may include a locking portion 6 formed on the handle base 1 and a locked portion 5 formed on the escutcheon member 3 and snap-locked onto the locking portion 6. The plurality of connecting portions 4 may include: a first connecting portion 4-1 including an inclined surface 7 which causes a motion component force toward the frame exterior to be generated in the escutcheon member 3 by a horizontal operating force applied to the escutcheon member 3, thereby unlocking the first connecting portion; a second connection portion 4-2 which is unlocked by deforming the escutcheon member 3 using a moveable region in a vicinity of the first connection portion generated by the unlocking in the first connecting portion 4-1; and an n-th connection portion 4-n which is unlocked by deforming the escutcheon member 3 using the moveable region due to the unlocking in the preceding connection portions 4-1, 4-2.

BRIEF DESCRIPTION OF DRAWINGS

FIG. 1 (*b*) is a view as seen from a direction of an arrow 1B in FIG. 1 (*a*).

FIG. 2 (*b*) is a view as seen from a direction of an arrow 2B in FIG. 2 (*a*).

FIG. 3 (*b*) is a sectional view taken along a line 3B-3B in FIG. 2 (*a*).

FIG. 4 (*b*) is a view as seen from a direction of an arrow 4B in FIG. 4 (*a*). FIG. 4 (*c*) is a view as seen from a direction of an arrow 4C in FIG. 4 (*a*). FIG. 4 (*d*) is a sectional view taken along a line 4D-4D in FIG. 4 (*a*).

FIG. 5 is a perspective view showing a handle base.

FIG. 6 is a sectional view taken along a line 6B-6B in FIG. 1 (*b*).

FIG. 7 (*b*) is an enlarged view of a main portion of FIG. 6, showing a first connecting portion (4-1). FIG. 7 (*c*) is a view showing an unlocked state of the first connecting portion (4-1).

DESCRIPTION OF EMBODIMENTS

Hereinafter, an exemplary embodiment of the present invention will be described with reference to the drawings. The exemplary embodiment is illustrative and not intended to limit the present invention. It should be noted that all features and combinations of the features described in the exemplary embodiment are not necessarily essential to the present invention.

Figure 1A:
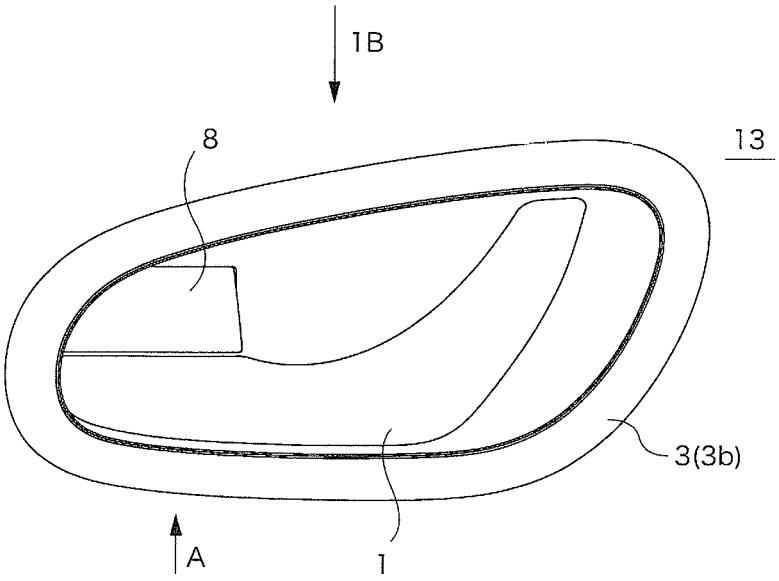
[FIG. 1] FIG. 1 (*a*) is a front view showing a door inside handle device according to an exemplary embodiment.
Figure 1B:
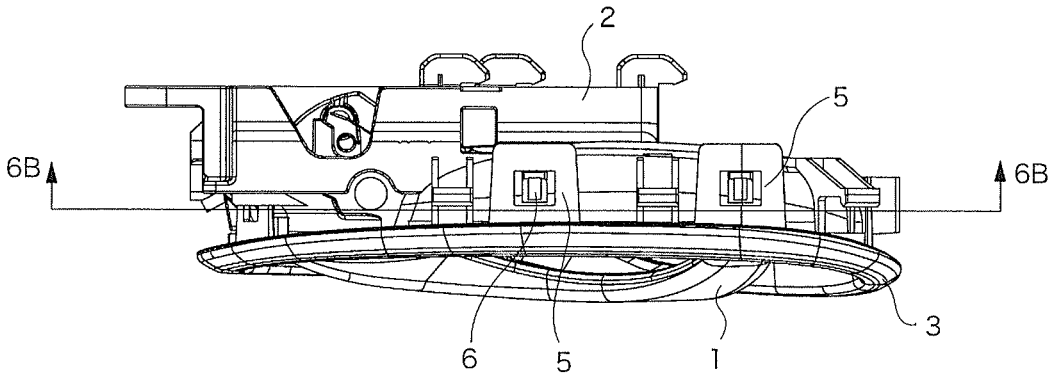
Figure 2A:
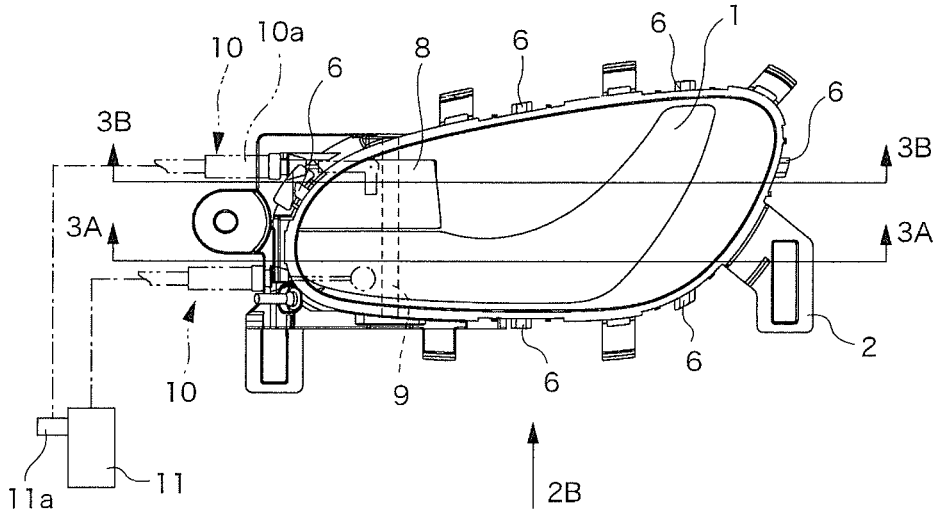
[FIG. 2] FIG. 2 (*a*) is a front view showing the inside handle device in a state where an escutcheon member 3 is not mounted thereto.
Figure 2B:
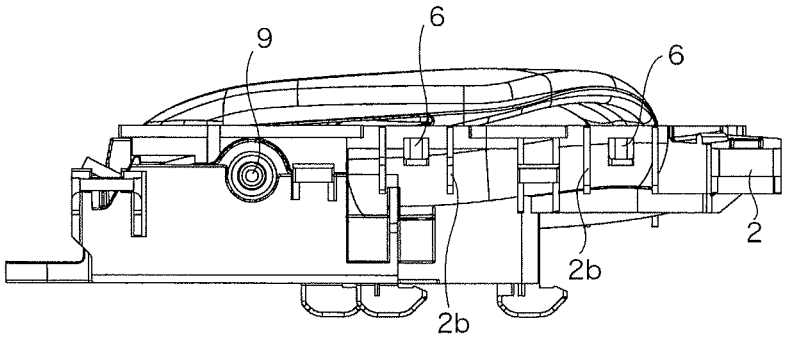

As shown in FIG. 1 (*a*) to FIG. 2 (*b*), an inside handle device of the exemplary embodiment includes a handle base 2 which pivotally supports an operating handle 1 and a locking lever 8 to rotate around a pivot shaft 9 and an escutcheon member 3 connected to the handle base 2.

A cable device 10 in which an inner cable 10*b* is slidably inserted into an outer case 10*a* is connected to the operating handle 1 and the locking lever 8. As will be described later, when the operating handle 1 is operated to rotate from an initial position to an operating position, locking of a door lock device 11 is released and thus an opening operation of a door body can be performed. As the locking lever 8 is operated to rotate from an unlocked position to a locked position, a cancellation part 11*a* is operated to cancel the operation form the operating handle 1. Accordingly, the opening operation of the door body by the operating handle 1 becomes impossible.

Figure 3A:
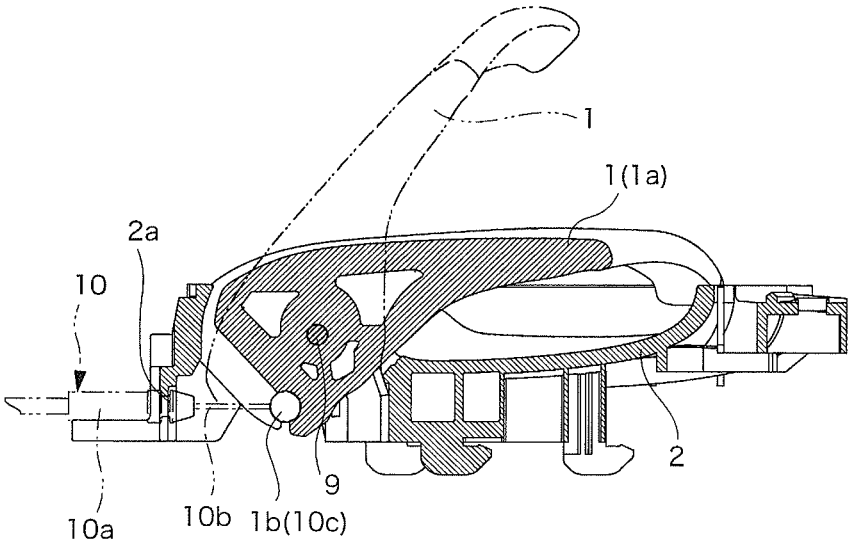
[FIG. 3] FIG. 3 (*a*) is a sectional view taken along a line 3A-3A in FIG. 2 (*a*).
Figure 3B:
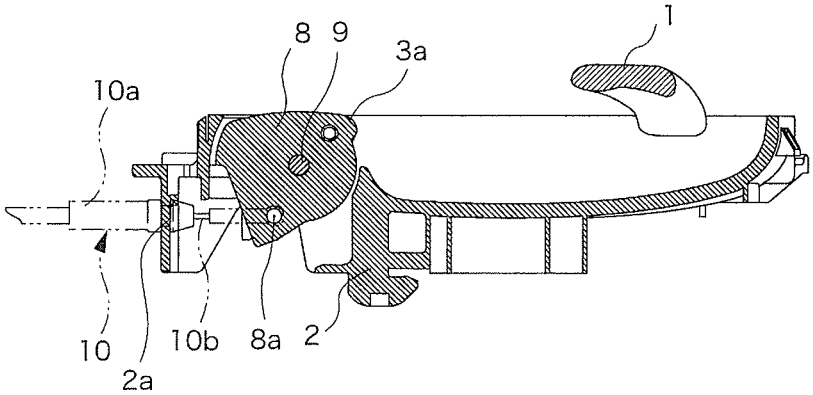
Figure 4A:
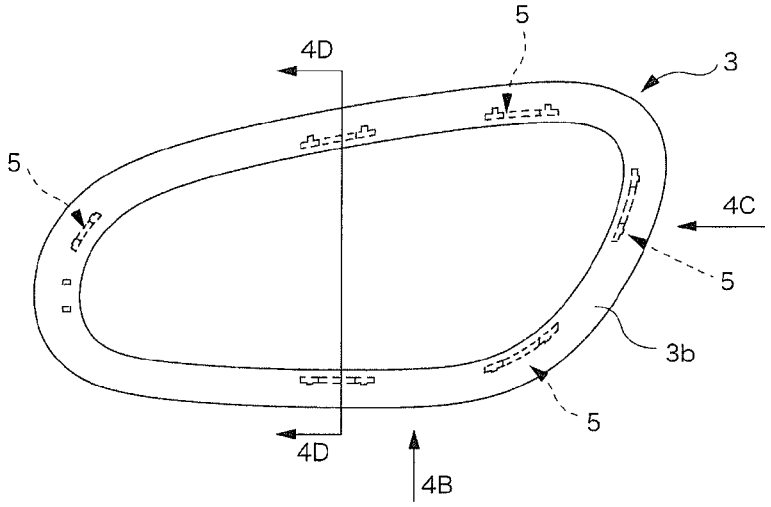
[FIG. 4] FIG. 4 (*a*) is a front view showing the escutcheon member.
Figure 4B:
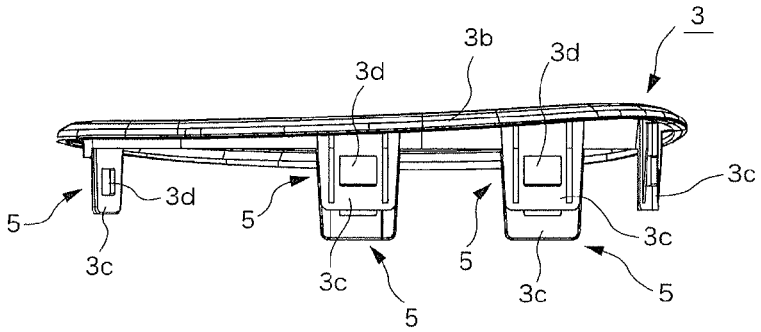
Figure 4C:
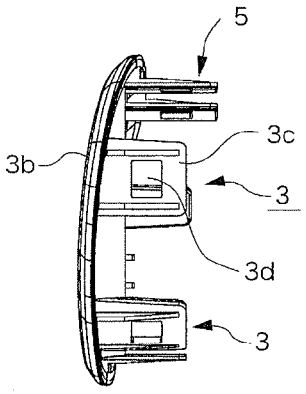
Figure 4D:
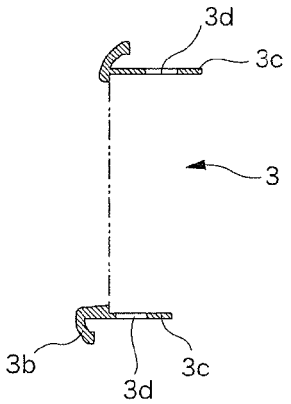
Figure 6:
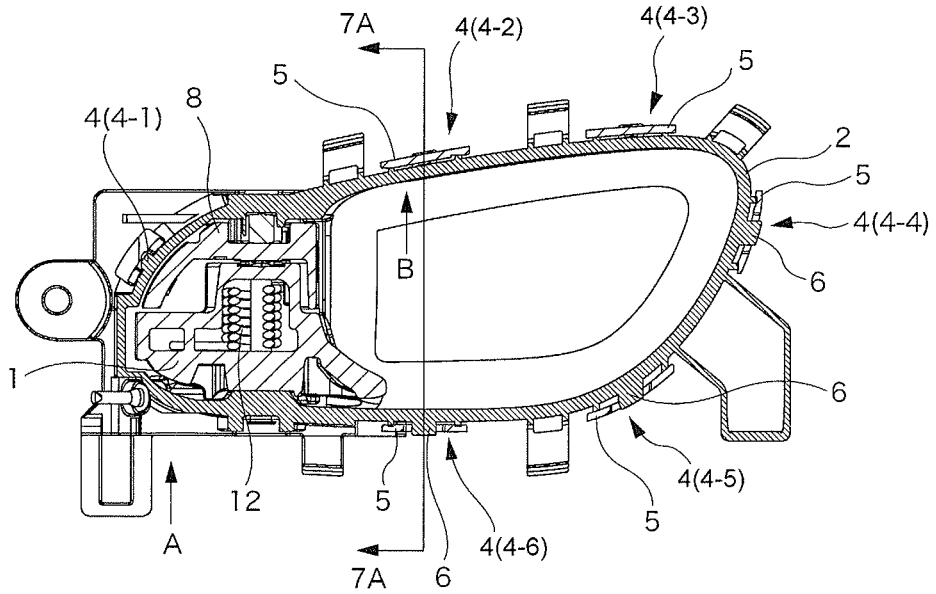
[FIG. 6]

The operating handle 1 includes a hand-grip part 1*a* at one end and a wire connection hole 1*b* at the other end with the center of rotation being therebetween. The operating handle is operated to rotate around the pivot shaft 9 between an initial position indicated by a solid line in FIG. 3 (*a*) and an operating position indicated by a dashed line in FIG. 3 (*a*). As shown in FIG. 6, an urging force toward the initial position is applied to the operating handle 1 by a torsion spring 12.

The cable device 10 is mounted to the operating handle 1 by locking an end of the outer case 10*a* to a cable locking part 2*a* formed on the handle base 2 and fitting a spherical cable end 10*c* fixed to a leading end of the inner cable 10*b* into the wire connection hole of the operating handle 1.

Meanwhile, the locking lever 8 is formed by injection molding a synthetic resin material. The locking lever 8 includes an operation protruding part 3*a* at an external exposed surface when being mounted on the handle base 2 and a cable mounting hole 8*a* at an opposite end with the pivot shaft 9 being therebetween. The cable mounting hole 8*a* is intended to connect the cable end of the inner cable 10*b* to the locking lever.

The escutcheon member 3 is a decorative part to improve the aesthetic appearance by covering a boundary of a door trim 13 and the handle base 2. In the exemplary embodiment, the escutcheon member 3 includes a frame-shaped main body 3*b* and six locked parts 5 formed substantially at equal intervals on a rear surface of the main body 3*b*, as shown in FIGS. 4 (*a*) to (*d*). The main body 3*b* of the escutcheon member 3 is formed from a synthetic resin material having a suitable elastic deformability and each locked part 5 thereof is formed by providing a locking hole 3*d* on the center portion of a thin-plate shaped tongue 3*c* integrally suspended from the main body 3*b*.

Figure 5:
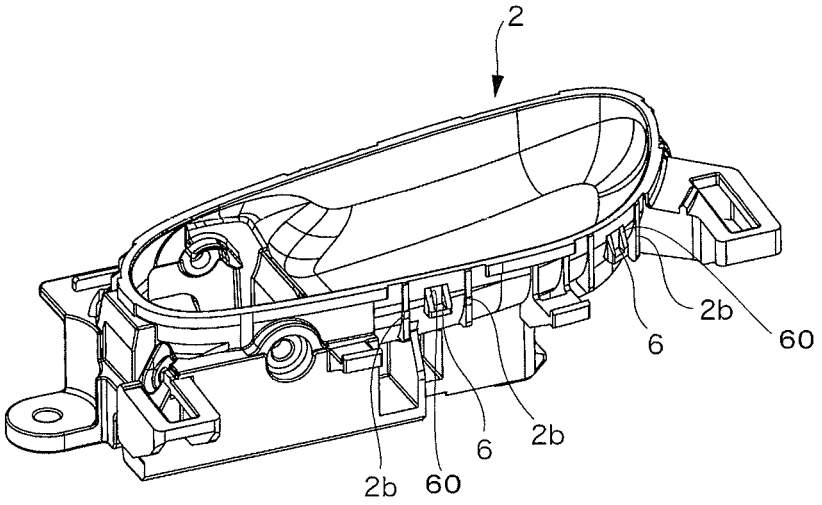
[FIG. 5]
Figure 7A:
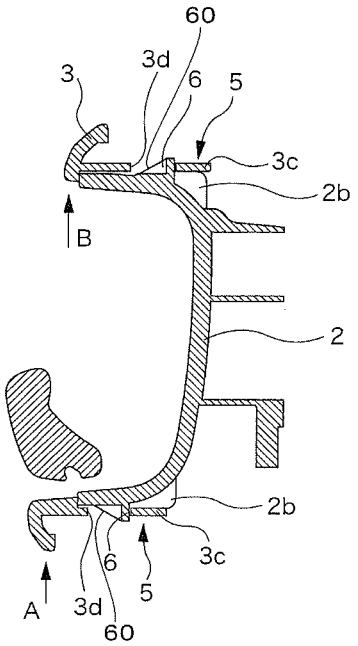
[FIG. 7] FIG. 7(*a*) is a sectional view taken along a line 7A-7A in FIG. 6.
Figure 7B:
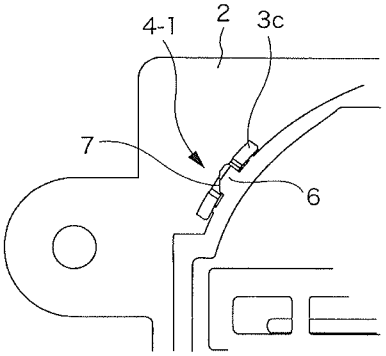
Figure 7C:
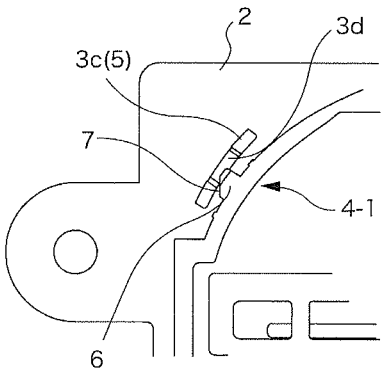

Meanwhile, the handle base 2 is formed in the shape of a tray having a suitable depth so as to provide a space for operating the hand-grip part of the operating handle 1. The handle base 2 is formed at its outer peripheral wall surface with a locking part 6 to which the locked part 5 of the escutcheon member 3 can be locked. As shown in FIG. 5 and FIG. 7 (*a*), each locking part 6 is formed in the shape of a triangular prism having a slanted surface 60. A protruding amount of the slanted surface 60 from the outer peripheral wall surface of the handle base 2 is gradually increased toward the lower side.

Mounting of the escutcheon member 3 is carried out by pushing the escutcheon member 3 from the above of the handle base 2. By the pushing operation of the main body 3*b*, each locked part 5 is interfered with the locking part 6 and then elastically deformed to avoid the locking part 6. Thereafter, as the escutcheon member 3 is further pushed down, each locked part 5 is snap-locked onto the locking part. In this way, a connection portion 4 is configured. In order to manage the locked size of the locked part 5 and the locking part 6 in each connection portion 4, a receiving seat 2*b* is formed on the handle base 2 adjacent to the locking part 6. The locking state of the locked part 5 is maintained in a state where the tongue 3*c* is bearing on the receiving seat 2*b*.

In the exemplary embodiment, the connection portion 4 includes six connection portions of first connection portion (4-1) to the sixth connection portion (4-6) in corresponding to the locked locations of the locking part 6 and the locked part 5. Out of the six connection portions, the first connection portion (4-1) includes a slanted surface 7 on a side wall portion of the locking part 6, as shown in FIG. 7 (*b*). As indicated by an arrow A in FIG. 1, FIG. 6 and FIG. 7 (*a*), by pressing a side wall portion of the escutcheon member 3 facing the second connection portion (4-2) in parallel to a surface of the door trim 13, a component force in a direction opened to the outside can be applied to the locked part 5.

As shown in FIG. 7 (*b*), the slanted surface 7 of the first connection portion (4-1) has a shape in which a protruding amount of the locking part 6 from the outer peripheral wall surface of the handle base 2 is gradually increased toward a direction along the outer peripheral wall surface of the handle base 2, in a cross-section (that is, a horizontal cross-section, the cross-section in FIG. 7 (*b*)) perpendicular to an up-down direction.

Accordingly, in the exemplary embodiment, in the mounted state of the escutcheon member 3 shown in FIG. 7 (*a*), the locked part 5 in the first connection portion (4-1) rides on the locking part 6 when the above-described horizontal operating force is applied to the escutcheon member 3 and the escutcheon member 3 is pushed outward, as shown in FIG. 7 (*c*) and the movement restraint of the escutcheon member 3 in the first connection portion (4-1) is released.

Thereafter, when a force from the inner side toward the outer side is applied to the escutcheon member 3 of the second connection portion (4-2) placed at a position opposed to the first connection portion (4-1), as indicated by an arrow B in FIG. 6 and FIG. 7 (*a*), the locking state of the locked part 5 and the locking part 6 is released while accompanying the deformation and movement of the released main body 3*b* in the first connection portion (4-1). In this way, the connection in the second connection portion (4-2) is released.

And then, the third, the fourth, the fifth and the sixth connection portions 4 are similarly released in this order and therefore the escutcheon member 3 can be detached.

Here, the arrangements after the second connection portion (4-2) are not limited to those shown but suitably determined in consideration of the locking state of each connection portion 4, the deflection property of the main body of the escutcheon member 3, etc.

As described above, according to the exemplary embodiment, the door inside handle device includes the handle base 2 pivotally supporting the operating handle 1, the frame-shaped escutcheon member 3 mounted on an upper edge portion of the handle base 2 and a suitable number of connection portion 4 composed of the first, the second, . . . the n-th connection portion (4-1, 4-2, . . . 4-n) connecting the escutcheon member 3 to the handle base 2. (Although the number of the connection portion 4 is six in the above specific embodiment, the number of the connection portion 4 is not limited to six and the function of the connection portion 4 is achieved even if the number of the connection portion is not six).

The escutcheon member 3 has a proper elastic deformability and each connection portion 4 connects the escutcheon member 3 and the handle base 2 by snap-locking the locked part 5 of the escutcheon member 3 onto the locking part 6 of the handle base 2.

The first connection portion (4-1) includes the slanted surface 7 which causes a motion component force toward the exterior to be generated in the escutcheon member 3 by the horizontal operating force applied to the escutcheon member 3 to release the locked state. The second connection portion (4-2) and the n-th connection portion (4-n) can be formed to be unlocked by an deformation operation to the escutcheon member 3 using the deformability or movement possibility which is newly generated in the whole escutcheon member 3 by the locking release of a preceding connection portion, that is, the first connection portion (4-1) in the case of the second connection portion (4-2) and an (n-1)th connection portion (4) in the case of the n-th connection portion (4-n).

Therefore, according to the exemplary embodiment, the escutcheon member 3 can be detached from the handle base 2 by first applying a horizontal operating force along a door inner wall surface, specifically a trim surface to the escutcheon member 3 to unlock the first connection portion (4-1) and then sequentially unlocking the second, the third . . . the n-th connection portion (4-n) while applying an operation force to the escutcheon member 3.

As a result, since an especial tool, etc. to detach the escutcheon member 3 is not required and also it is not necessary to provide a tool insertion opening, etc., it is possible to improve the aesthetic appearance.

According to the structure of the exemplary embodiment, it is possible to improve the workability of the detaching operation of the escutcheon member and also to improve the aesthetic appearance.

DESCRIPTION OF REFERENCE NUMERALS

1 OPERATING HANDLE
2 HANDLE BASE
3 ESCUTCHEON MEMBER
4 CONNECTION PORTION
4-1 FIRST CONNECTION PORTION
4-2 SECOND CONNECTION PORTION
4-n Nth CONNECTION PORTION
5 LOCKED PART
6 LOCKING PART
7 SLANTED SURFACE

The invention claimed is:

1. A vehicle door handle device comprising:

a handle base to which an operating handle is pivotally supported;

a frame-shaped escutcheon member which is connected to an upper edge portion of the handle base and is elastically deformably formed; and a plurality of connection portions which connect the handle base and the escutcheon member to each other, wherein each of the plurality of connecting portions includes a locking portion formed on the handle base and a locked portion formed on the escutcheon member and snap-locked onto the locking portion, wherein the plurality of connecting portions include:

a first connection portion including an inclined surface which causes a motion component force to be generated in the escutcheon member by a horizontal operating force applied to the escutcheon member, thereby unlocking the first connection portion, wherein the inclined surface has a shape in which a protruding amount from an outer peripheral wall surface of the handle base is gradually increased toward a direction along the outer peripheral wall surface of the handle base, in a horizontal cross-section;

a second connection portion which is unlocked by deforming the escutcheon member using a moveable region in a vicinity of the first connection portion generated by the unlocking in the first connecting portion; and an n-th connection portion which is unlocked by deforming the escutcheon member using the moveable region due to the unlocking in the preceding connection portions, and wherein the first connection portion is configured to be unlocked by the horizontal operating force while the second connection portion and the n-th connection portion are kept in locked states.

2. The vehicle door handle device according to claim 1, wherein the locked part has a thin-plate shape and is provided at its center with a rectangular opening, wherein the locking part has a shape which protrudes from the handle base and is fitted to the rectangular opening, and wherein the inclined surface is formed on a side wall portion of the locking part.

3. The vehicle door handle device according to claim 1, wherein each of the second connection portion and the n-th connection portion does not include an inclined surface which causes a motion component force to be generated in the escutcheon member by the horizontal operating force applied to the escutcheon member for unlocking the first connection portion.

4. A vehicle door handle device comprising:

a handle base to which an operating handle is pivotally mounted;

a frame-shaped escutcheon member which is connected to an upper edge portion of the handle base and is elastically deformable; and a plurality of connection portions which connects the handle base and the escutcheon member to each other, wherein each of the plurality of connection portions includes a locking portion formed on an outer periphery of the handle base and a locked portion formed on the escutcheon member and snap-locked onto the locking portion, the plurality of connection portions include:

a first connection portion including an inclined surface which causes a motion component force to be generated in the escutcheon member by a horizontal operating force applied to the escutcheon member, thereby unlocking the first connection portion, wherein the inclined surface has a shape in which a protruding amount from an outer peripheral wall surface of the handle base is gradually increased toward a direction along the outer peripheral wall surface of the handle base, in a horizontal cross-section;

a second connection portion which is unlocked by deforming the escutcheon member using the moveable region in the vicinity of the first connection portion generated by the unlocking in the first connection portion; and a third connection portion which is unlocked by deforming the escutcheon member using the moveable region due to the unlocking in the first and second connection portions, wherein the operating handle is pivotable around a pivotal axis extending in a first direction, and wherein the locking portion of the first connection portion is located on a first portion of the outer periphery of the handle base, and a tangential line of the outer periphery of the handle base at the first portion is not parallel to a second direction which is perpendicular to the first direction.

5. The vehicle door handle device according to claim 4, further comprising a locking lever pivotally mounted to the handle base, wherein the locking portion of the first connection portion is located on an opposite side of a hand-grip part of the operating handle with respect to both the pivotal axis of the operating handle and a pivotal axis of the locking lever in the second direction.

6. The vehicle door handle device according to claim 5, further comprising a pivot shaft, wherein both the pivotal axis of the operating handle and the pivotal axis of the locking lever are commonly located on the pivot shaft.

7. A vehicle door handle device comprising:

a handle base to which an operating handle is pivotally supported;

a frame-shaped escutcheon member which is connected to an upper edge portion of the handle base, the frame-shaped escutcheon member having a main body formed of an elastically deformable material; and a plurality of connection portions which connect the handle base and the escutcheon member to each other, wherein each of the plurality of connection portions includes a locking portion formed on the handle base and a locked portion formed on the escutcheon member and snap-locked onto the locking portion, wherein the plurality of connection portions include:

a first connection portion including an inclined surface which causes a motion component force to be generated in the escutcheon member by a horizontal operating force applied to the escutcheon member, thereby unlocking the first connection portion;

a second connection portion which is unlocked by elastically deforming the main body of the escutcheon member using a moveable region in a vicinity of the first connection portion generated by the unlocking in the first connection portion; and an n-th connection portion which is unlocked by elastically deforming the main body of the escutcheon member using the moveable region due to the unlocking in the preceding connection portions, and wherein the first connection portion is configured to be unlocked by the horizontal operating force while the second connection portion and the n-th connection portion are kept in locked states.

* * * * *